US005121921A

United States Patent [19]

Friedman et al.

[11] Patent Number: 5,121,921

[45] Date of Patent: Jun. 16, 1992

[54] CARD DEALING AND SORTING APPARATUS AND METHOD

[76] Inventors: Willard Friedman, 1227 South 113th Plaza, Omaha, Nebr. 68144; Robert C. Geschwender, 3855 Orchard, Lincoln, Nebr. 68503

[21] Appl. No.: 764,250

[22] Filed: Sep. 23, 1991

[51] Int. Cl.[5] ..... A63F 1/14

[52] U.S. Cl. ..... 273/149 P

[58] Field of Search ..... 273/149 P, 149 R

[56] References Cited

U.S. PATENT DOCUMENTS 2,016,030 10/1935 Woodruff et al. ..... 273/149 R
3,312,473 4/1967 Friedman et al. ..... 273/149 P
4,534,562 8/1985 Cuff et al. ..... 273/149 P
4,822,050 4/1989 Normand et al. ..... 273/149 P
4,951,950 8/1990 Normand et al. ..... 273/149 P

*Primary Examiner*—Benjamin Layno
*Attorney, Agent, or Firm*—John A. Beehner

[57] ABSTRACT

A card dealing and sorting apparatus adapted for use with a conventional deck of cards. The apparatus includes a frame onto which is movably mounted a card holding device. The card holding device holds the deck of cards, the lowermost cards being removed by a card removing device. The removed card falls down an open well where it is directed into a desired card holding compartment by a series of gates which either intercept the falling card or allow it to pass by. The gate position information is encoded on a program strip which is read by a strip reading device, the information being translated to the gates for positioning of the same.

20 Claims, 4 Drawing Sheets

CARD DEALING AND SORTING APPARATUS AND METHOD

BACKGROUND OF THE INVENTION

1. Technical Field

This invention relates to card dealing apparatuses, and, more particularly, to a card dealing and sorting machine which can deal and sort a deck of cards into a plurality of preselected hands in which each hand contains specific predetermined cards.

2. Description of the Prior Art

Since the invention of the playing card, mankind has been fascinated by card games. Games such as poker, bridge, rummy and gin have challenged and delighted players of all ages and skills. Of these games, however, the one which has attracted some of the most dedicated players is bridge. One of the problems encountered in dealing and playing bridge occurs in a tournament when duplicate hands are to be dealt to a number of different players to remove the element of luck in the dealing of the cards. Another problem can come up when a player would like to try his or her skill at playing the same hand that a bridge master played, to see how their technique measures up to that of the expert.

Another problem present is that prior art devices such as that of Friedman, U.S. Pat. No. 3,312,473, require electric current to work, are somewhat complex and have experienced certain problems developing in them, and use less efficient methods to accomplish what the present invention accomplishes. Moreover, these devices cannot be easily modified to deal different card games, as can the present invention.

Accordingly, an object of the present invention is to provide a card dealing and sorting machine which can deal a plurality of preselected hands.

Another object is to provide a card dealing and sorting machine which enables card players to duplicate hands over and over, for uses such as in tournaments.

Yet another object is to provide a card dealing and sorting machine which is adapted to sort a standard deck of playing cards.

Still another object is to provide a card dealing and sorting machine which utilizes a minimum number of parts for assuring a minimum possibility of breakdown.

Other objects and advantages of the present invention will become apparent from the following description, drawings, and claims. The scope of the invention shall not be limited to the drawings themselves as the drawings are only for the purpose of illustrating one embodiment of the present invention.

SUMMARY OF THE INVENTION

The present invention provides a method of dealing and sorting cards in a prearranged pattern, and a machine for implementation of that method to assist in the playing of card games such as duplicate bridge and to aid in the teaching of card games such as bridge.

The machine consists of a frame onto which is mounted a movable card holding device. Attached to the frame and underneath the card holding device is a card removing means, which removes cards one at a time from the bottom of the deck. An open well is defined by the frame and is set relative to the card removing means such that when a card is removed from the deck, it falls down the well. Set into the front of the well are a plurality of gates which open or close depending on which hand the falling card is meant to fall into. The card falls into and is then held by a removable card holding compartment supported by the frame. The information for the gate positions is held on a flexible strip which has holes in it. These holes are configured so that the strip reading means, which consists of a plurality of levers which either engage or disengage according to the location of the holes on the strip, can read the information thereon. The gates are thus controlled by the information on the strip.

The method for dealing and sorting cards is as follows:

First, a deck of cards is placed in the card holding device on top of the card dealing and sorting device. The information-bearing strip is then slid into the strip reading means to its starting point. The card holding device is then slid back and forth, thus removing a card. The removed card then falls down the open well where the card is directed into the desired card holding compartment by the appropriately positioned gates, as read from the information bearing strip. This process is repeated until the entire deck is sorted. After sorting, the individual card holding compartments can be removed, and the hand held therein with it.

As is readily seen from the previous description, this method of card dealing and sorting is efficient, simple, and quick. The above described machine provides the most effective means for accomplishing the described task, and can be utilized in many different situations.

DESCRIPTION OF THE PREFERRED EMBODIMENT

Figure 1:
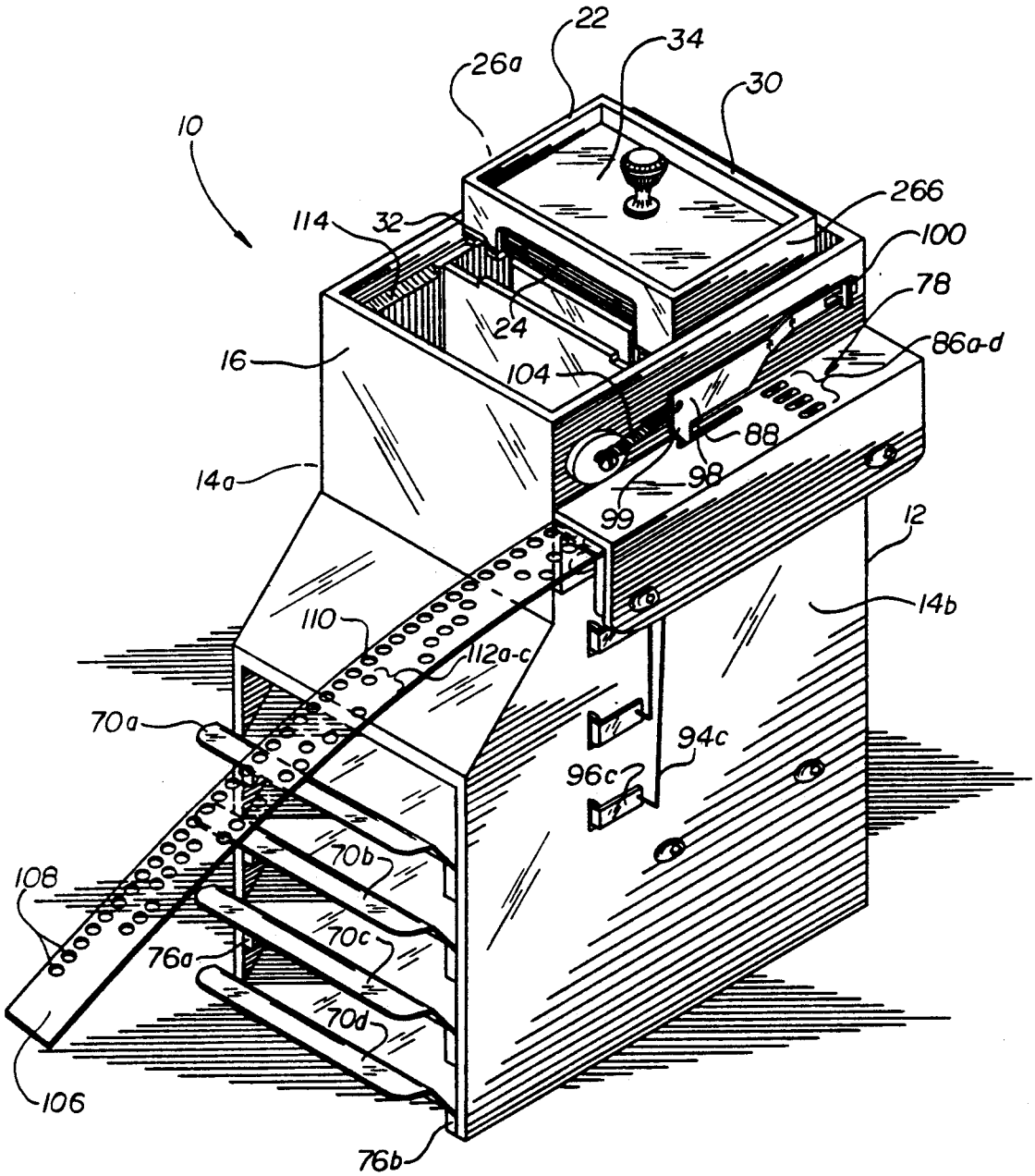
FIG. 1 is a perspective view of the card dealing and sorting machine showing the basic exterior elements of the machine in one possible arrangement.
Figures 2, 3:
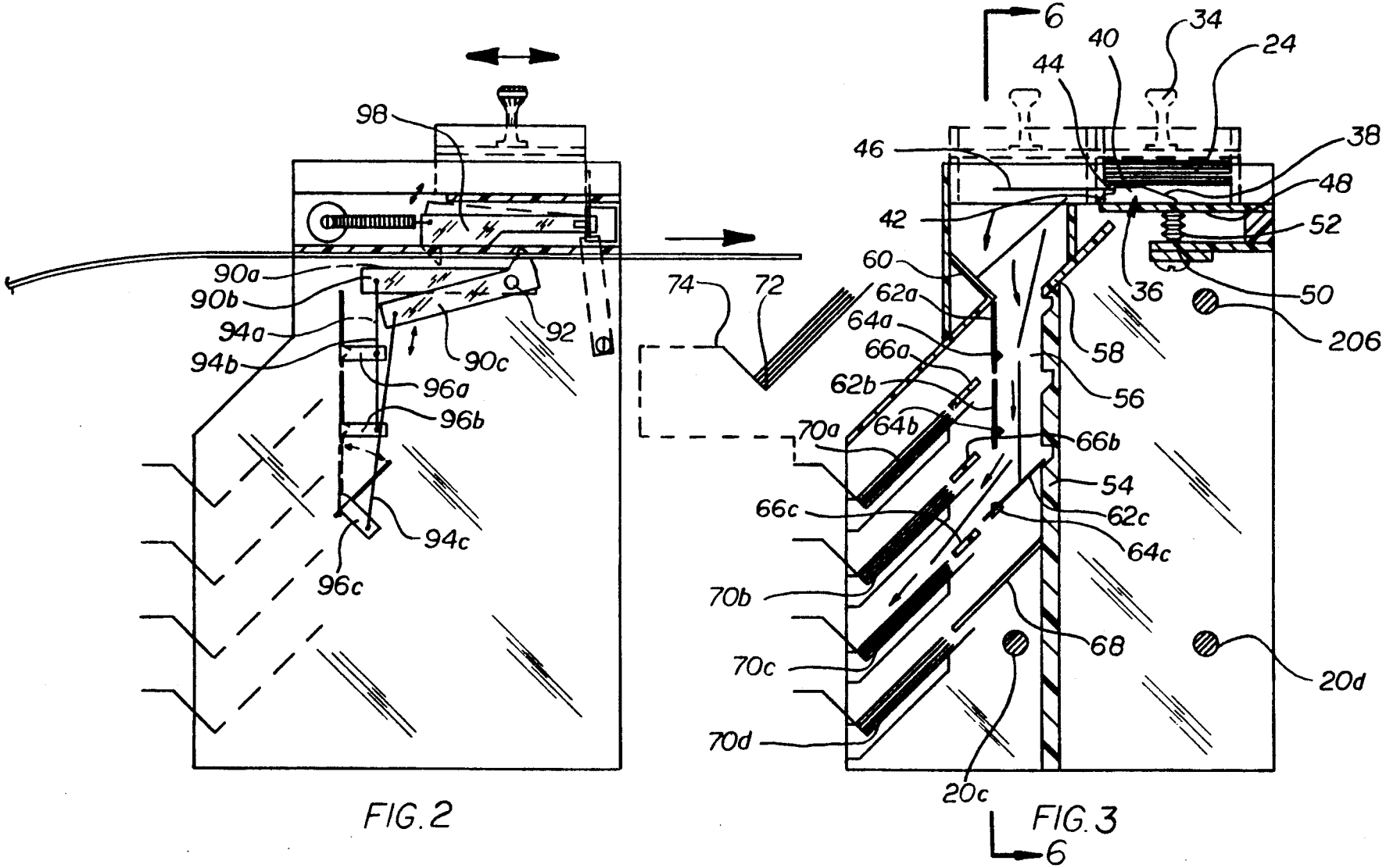
FIG. 2 is a side elevational view of the machine showing the workings of the gate tab extensions, the strip reading device and the slidably mounted card holder.
FIG. 3 is a sectional side elevational view of the present invention showing the working of the gages and how a card is removed from the deck, sorted, and then how the card holding compartments for the sorted cards can be removed.

The card dealing and sorting machine 10 is shown in its preferred embodiment in FIGS. 1-3 as including a frame 12 onto which are mounted the actual workings of the machine. The frame 12 consists of two side walls 14*a* and 14*b* and a front wall 16 which extends between and is connected to side walls 14*a* and 14*b* and extends downward from the upper front edges of the side walls 14*a* and 14*b* approximately ½ the height of the side walls 14*a* and 14*b*. The side walls 14*a* and 14*b* are wider at the base than at the top in the preferred embodiment, to better accommodate the other elements of the machine. Extending between and connected to the upper rear edges of the side plates 14*a* and 14*b* is partial rear wall 18 which extends approximately 1/6 of the way down the side walls 14*a* and 14*b* in the illustrated embodiment.

The walls of the frame 12 are constructed out of plastic in the preferred embodiment, but may be formed of any similar structural material.

Figure 4:
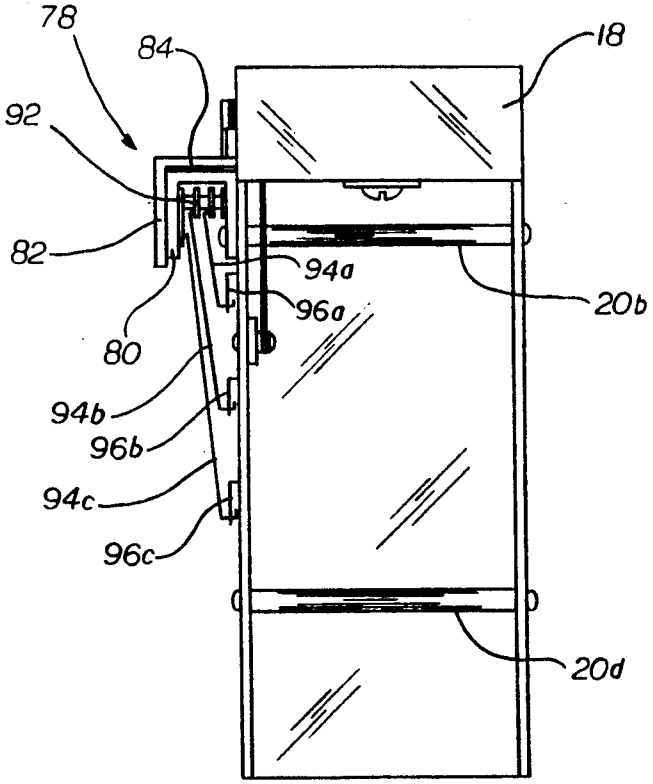
FIG. 4 is a rear view of the card dealing and sorting machine showing two of the strengthening struts of the apparatus.

Four strengthening struts 20*a–d*, shown in FIG. 4, extend between and are connected to the side walls 14*a* and 14*b* at spaced-apart positions thereon.

Figure 5:
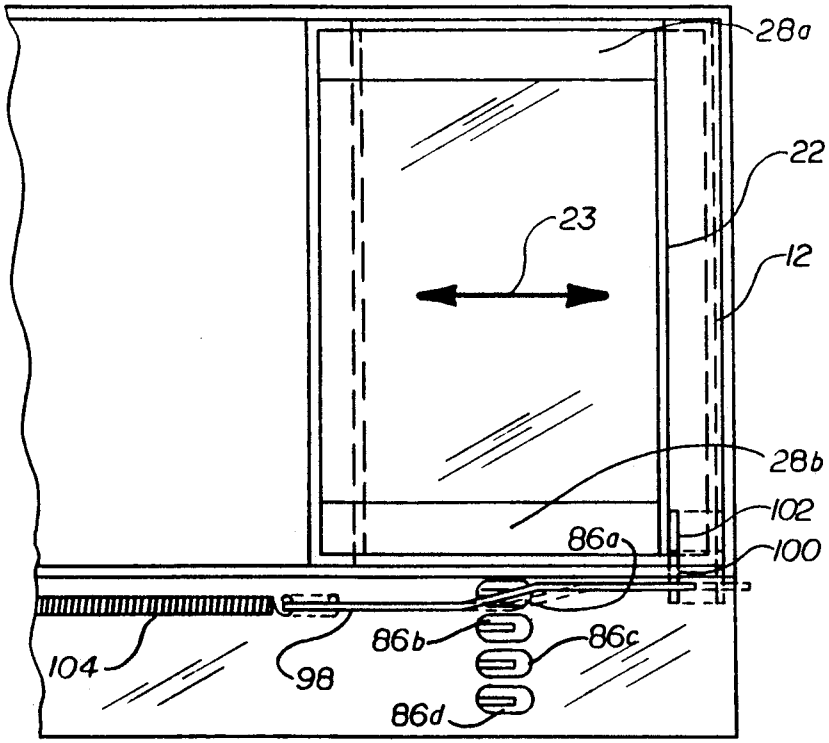
FIG. 5 is an enlarged top plan view of the card dealing and sorting machine showing how the information bearing strip is advanced by the motion of the card holding device.

Slidably mounted on top of the frame 12 is a card holding device 22. The card holding device 22 can slide back and forth on top of the frame, as seen in FIGS. 3, 5, and 6, and as indicated by arrow 23 in FIGS. 5 and 5*a*. As best seen in FIG. 1, the shape of the card holding device 22 is a rectangular box with open top and bottom, and is adapted such that an ordinary deck of cards 24 will fit within and substantially fill the device 22. Attached to the bottom of the open box on the shorter sides 26*a* and 26*b*, as shown in FIG. 5, are a pair of support plates 28*a* and 28*b*. The support plates 28*a* and 28*b* are connected to the lower edges of the sides 26*a* and 26*b* and rear 30 of the box. In this fashion, a deck of cards 24 is supported by the support plates 28*a* and 28*b* such that the lowermost card 46 of the deck 24 can be removed by sliding it out through the front slot 32 in the card holding device 22.

Placed atop the deck of cards 24 is a weight 34 which holds the deck of cards down to facilitate their removal. The weight 34 can be made of a rectangular piece of plastic or metal of the kind used in construction of the frame 12.

The card removal means 36 can best be seen in FIG. 3. The card removal means 36 is preferably made of one rectangular piece of metal having three sections approximately $\frac{1}{8}$" thick at the thickest point. The rear section 38 of the card removal means 36 slopes downward, decreasing the thickness from $\frac{1}{8}$" to 0" at the rear. The middle section 40 is of constant $\frac{1}{8}$" thickness. The front section 42 is a downward sloping convex curve, with the thickness of the section changing from slightly less than 150 " down to 0" , from the rear of the section frontwards. The height of the shoulder formed at the juncture between the front and middle sections 42 and 40 is preferably of a height equal to the thickness of one standard playing card. In the preferred embodiment, the card removal means 36 is positioned such that the lowermost card 46 in the card holding device 22 is in contact with the card removal means 36, approximately centered transversely in the frame 12, and aligned longitudinally such that the shoulder 44 is aligned with the rear wall 30 of the card holding device 22 when that device is moved as far frontwards as it will move.

Supporting the card removal means 36 is a support plate 48 attached to and extending from the partial rear wall 18 of the frame 12 in a plane substantially parallel to the sliding plane of the card holding device 22. Substantially parallel to the support plate 48 is an adjustment screw holding plate 50 extending between the side walls 14*a* and 14*b* of the frame 12, connected to the aforementioned side walls 14*a* and 14*b* and the partial rear wall 18 of the frame 12, and extending outwards from the rear wall 18 approximately $\frac{1}{2}$ the length of the support plate 48, as shown in FIG. 3. A card removal means adjustment screw 52 extends upwards through the adjustment screw holding plate 50 and contacts the underside of the support plate 48. By extending or retracting the adjustment screw 52, the height of the card removal means 36 can be adjusted.

Extending upwards from the bottom of the side walls 14*a* and 14*b* and extending between and connected to the aforementioned side walls 14*a* and 14*b* is a rear wall 54, which extends upwards until the upper edge of the wall 54 is at the approximate elevation of the support plate 48, as shown in FIG. 3. The rear wall 54 defines one element of the open well 56 down which cards may fall. In the preferred embodiment the rear wall 54 is positioned at approximately the midpoint of the lower section of the sidewalls 14*a* and 14*b*, and is substantially perpendicular to the lower edges of the sidewalls 14*a* and 14*b*. Extending downwards and frontwards from the rear wall 54 is a card directing plate 58 which helps to guide cards into the open well 56. Extending downwards and rearwards from the front wall 16 is another card directing plate 60 which further guides falling cards into the open well 56. In the preferred embodiment, card directing plate 60 extends downward from $1\frac{3}{4}$" below the top edge of the front wall 16, and card directing plate 58 extends downward from approximately $\frac{1}{4}$" below the top edge of the rear wall 54. The portion of rearwall 54 below plate 58 may be arranged forwardly of the portion above plate 58 as shown in FIG. 3.

In the preferred embodiment, and as best shown in FIG. 6, the front surface of the open well 56 is formed by a set of three gates 62*a–c*. Each gate 62*a–c* consists of a rectangular piece metal whose length on the long side is slightly less than the distance between the two side walls 14*a* and 14*b*. Each gate 62*a–c* is pivotably mounted, such that the pivoting axis is parallel with the longitudinal axis of each gate 62*a–c* and preferably along one long edge of the gate. Along the pivoting axis, two opposing tabs protrude from the rectangular piece of metal. These tabs are roughly rectangular in shape and in effect extend the length of one long side of the rectangle, so that the tab can extend through the pivot joints to be outlined below, thus allowing for pivoting motion of the gates 62*a–c*. The pivot joints 64*a–c* are pairs of holes placed in the side walls 14*a* and 14*b* opposite each other and in the same generally horizontal plane. Three pairs of holes should be formed, and the aforementioned tabs extended therethrough on each side. The gates 62*a–c* will then be supported and able to be pivoted about the pivot axis.

In the preferred embodiment, the gates would be aligned such that when in the card bypass position, as gates 62*a* and 62*b* are pictured in FIG. 3, the gates substantially comprise a front well wall to allow non-binding motion of cards past the non-intercepting gates. Each gate could alternatively be in the card interception position, as gate 62*c* is pictured in FIG. 3, in which the gate is pivoted to be in contact with the rear wall 54 of the open well 56. The angle of the pivoted gate would preferably be sufficient to intercept and redirect the falling card into the desired card holding compartment, as described later.

Below and in front of each gate is a chute 66*a–c* which further directs the falling cards into the desired card holding compartment, as described below. Each chute 66*a–c* is preferably constructed of a flat rectangular plate of plastic approximately 1" in width and extending between and connected to the side walls 14*a* and 14*b*. The plastic plate is tilted at approximately a 45° angle from vertical and set so that a card, after redirection by the gate 62*a–c*, will continue along the desired path as further directed by the chute.

At the bottom of the open well is a final directing chute 68 which extends downwards and forwards from the rear wall 54. The final directing chute 54 is constructed of a rectangular piece of plastic extending between and connected to the side walls 14*a* and 14*b* and connected to the rear wall 54, and substantially parallel to chutes 66*a–c*.

Below and in front of the chutes 66*a–c* and 68 are the aforementioned card holding compartments 70*a–d*. In the preferred embodiment, these card holding compartments would each be constructed of a flat, rectangular metal plate with an approximately 90° first bend 72 placed in it, spaced approximately one-third of the length of the plate form a shorter side and parallel with the shorter side. A second bend 74 would be placed in the short bent section, the bend to be in the opposite direction of the first bend 72 and of approximately 30°. The second bend 74 is to be approximately 1/7 of the length of the plate from the short bent section side.

The card holding compartments 70*a–d* are each removably held in place by a pair of compartment supports 76*a* and 76*b* as seen in FIGS. 1 and 3. In the preferred embodiment, the compartment supports are formed from the same plastic as the frame 12 and L-shaped piece is formed. A pair of L-shaped pieces are attached to the interior of the side walls 14*a* and 14*b*, one to each side wall, and at the same height. The L-shaped pieces should be titled backwards, with the long leg of the L-shaped piece towards the rear and the L opening facing upwards. The alignment of the compartment support pairs 76*a* and 76*b* should be such that the card holding compartment 70*a–d* supported thereon is slightly below and in front of the cards into the compartment. The long section of the compartment is substantially parallel with the chute 66*a–c* or 68 leading to it. The card holding compartment 70*a–d* thus rest upon the compartment supports 76*a* and 76*b* and therefore can be removed easily.

Attached to the upper section of side wall 14*b*, as shown in FIG. 1, in the preferred embodiment is a strip-reading device 78 made up of a U-shaped channel so approximately 1" wide, 1¼" in height, and the same length as the width of the upper section of the side wall 14*b* in the illustrated embodiment. The channel 80 is inverted and attached to the side wall 14*b* such that the longitudinal axis of the channel is substantially parallel with the upper edge of the side wall 14*b* and the channel is above the uppermost gate pivot 64*a* but below the height of the card removal means 36.

Attached to the outer arm of the U-shaped channel 80 and substantially covering the outer arm and base of the channel 80 is an L-shaped plate 82. The L-shaped plate 82 is in contact with the channel 80, leaving a narrow gap 84 between the L-plate and the base of the channel, running the length of the two pieces. Both the L-shaped plate 82 and the U-shaped channel 80 would preferably be made of the same plastic as the frame 12.

In the preferred embodiment, approximately ⅓ of the length of the U-shaped channel 80 back from the rear of the frame 12 along the top of the L-shaped plate 82 a set of four flattened oval holes 86*a–d* would be drilled through both the top of the L-shaped plate 82 and the base of the U-shaped channel 80. These holes 86*a–d* should be equally spaced along an axis perpendicular to the longitudinal axis of the U-shaped channel 80. A slot 88 should also be cut into the top section of the L-shaped plate 82, approximately a the midpoint of the L-shaped plate 82, parallel with the longitudinal axis of the U-shaped channel 80, and in line with the hole 86*a* closest to the frame 12.

Beneath and inside of the U-shaped channel 80, in the preferred embodiment, are four gate-actuating levers 90*a–d*, as seen in FIGS. 2 and 4. These levers 90*a–d* are attached to an axle 92 which allows pivoting motion of the levers 90*a–d* in substantially vertical generally parallel planes, the axle being positioned approximately ½ beneath and in front of the holes 86*a–d*, and parallel with the transverse axis of the frame 12. The gate-actuating levers 90*a–d* are each constructed of a rectangular metal strut with a hole on one end and a tooth projecting upwards on the other. The axle is spaced approximately 1/6 of the way away from the toothed end of each lever 90*a–d*. The teeth are aligned such that when the hole ends of the levers are down, the teeth extend upwards through the holes 86*a–d* drilled in the L-shaped plate 82 and the U-shaped channel 80.

As best shown in FIG. 6, each lever 90*a–d* is connected to one gate 62*a–c* in such a way that when the lever 90*a–d* is actuated (i.e. the toothed end is pushed down) that gate is put into bypass position. In the rest or unactuated mode, all gates 62*a–c* are in intercept position. The connection means 94*a–c* each consist of a piece of metal wire in the preferred embodiment, one end looped through the hole at the end of a lever 90*a–d*, the other end attached to a tab extension 96*a–c* attached to the tab on a gate 62*a–c*. In this manner the information on each strip, discussed later, can be translated to the gates 62*a–c* to control them.

Above the L-shaped plate 82 in the preferred embodiment is the strip-advancing device 98, seen best in FIG. 1. The stripe-advancing device 98 is constructed of a metal strut which extends rearward from the front of the slot 88 to connect with a lever extension 100. The slot end of the strip-advancing device 98 further consists of a tooth 99 which extends downward into the slot 88. This allows engagement of the program strip, which will be explained later. The lever extension 100 is connected to a strip-advancing lever 102, the lever extension 100 extending through the rear of the side wall 14*b*. The strip-advancing lever 102 is connected at a pivot point 104, shown best in FIGS. 2 and 4, and extends upwards from that point up through a slot in the adjustment screw holding plate 50. Connected to the toothed end of the strip-advancing device 98 is spring 104, which at its other end is attached to the side wall 14*b*. This provides a tensioned return system for the strip-advancing device 98.

The aforementioned program strip 106 is preferably a flexible strip of a material such as plastic or metal, no thicker than the height of the narrow gap 84 between the L-shaped plate 82 and the U-shaped channel 80, and of approximately the same width as the base of the U-shaped channel 80, approximately 1". The gate control information on the strip is encoded in this embodiment by a plurality of holes 108 inserted through the strip in preferably four columns. The first column 110 would have holes in each row, as it is the column which the strip-advancing device 98 uses to advance the strip 106. The other three columns 112*a–c* all contain individual gate information, which is translated in the following manner. On any given line of information, there will be either one or two holes 108 on the line. If there is only one hole 108, that hole 108 will be the first column 110, the three gate actuating levers 90*a–c* will be actuated, the gate 62*a–c* will be actuated, and thus the gate 62*a–c* attached thereto will be in card bypass position. A card will then fall to the lowest card holding compartment 70*d*. If there are two holes 108, one hole 108 in the first column 110, the other hole 108 in one other column 112*a–c*, whichever column 112*a–c* the hole 108 is in will not have corresponding gate 62*a–c* actuated. The non-actuated gate will be in card intercept position and a falling card will be directed by the non-actuated gate 62*a–c* into the corresponding card holding compartment 70*a–c*.

Operation of the card dealing and sorting machine 10 is as follows. A deck of cards 24 is sorted and arranged in the following suit order: spades, hearts, diamonds, and clubs. Each suit, in turn, is sorted in sequence: ace, king, queen, jack, 10, etc., down to 2. Next, the deck of cards 24 is placed face down into the card holding device 22, with the card holding device 22 towards the rear of the sliding track 114 on top of the frame 12. On top of the deck of cards 24 is placed the weight 34 to hold the cards down. All of the card holding compartments 70*a–d* are placed on their respective compartment supports 76*a* and 76*b*, ready to receive sorted cards.

A program strip 106 is then slid into the strip-reading device 78 in the narrow gap 84, and is slid forward until the first line of information is under the holes 86*a–d*. The card holding device is then slid forward over the card removal means 36 and back, removing the lowermost card 46 when it is contacted by the ledge 44. The card 46 then falls downwards, directed by the front and rear card directing plates 58 and 60.

The card 46 then encounters the gates 62*a–c* which, depending on their being in card bypass or card intercept position, either direct the card 46 into the corresponding card holding compartment 70*a–d*, or allow the card 46 to pass by to the next gate 62*a–c*, to eventually reside in a card holding compartment 70*a–d*.

Figure 5A:
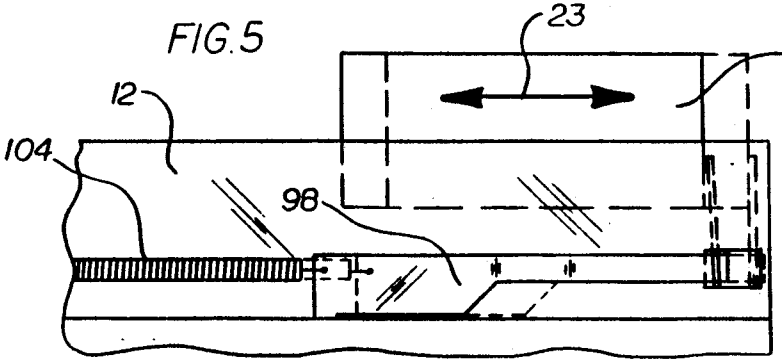
FIG. 5A is an enlarged partial side sectional view of the card dealing and sorting machine.
Figure 6:
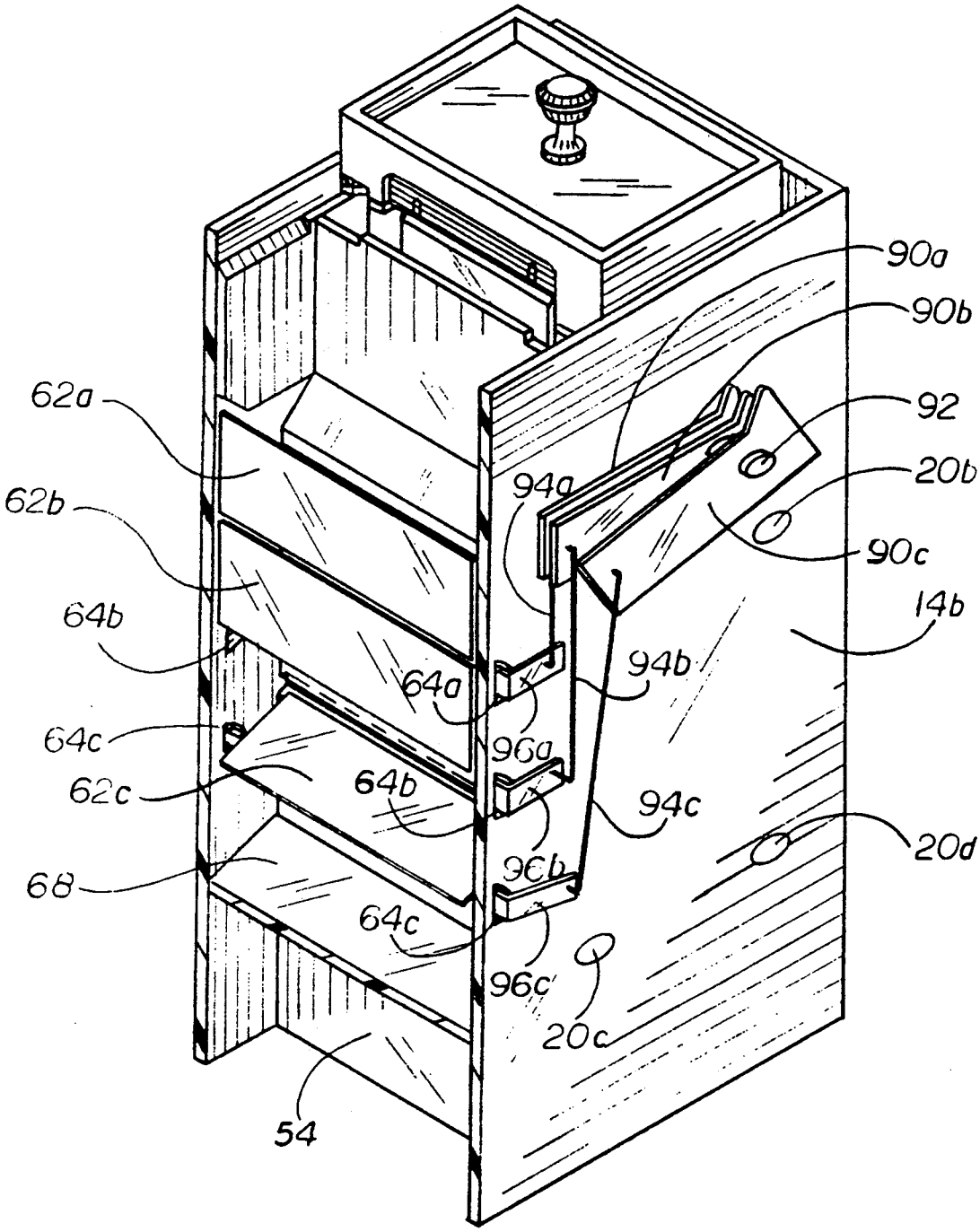
FIG. 6 is a sectional perspective view along line 6—6 in FIG. 3 the functioning of the gates in the card dealing and sorting machine.

The card holding device is then pushed all the way to the rear of the sliding track 114, encountering and pivoting the strip-advancing lever 102 as shown in FIG. 5A. The strip-advancing lever 102 in turn moves the lever extension 100 which then moves the strip-advancing device 98 towards the rear of the frame 12. The tooth 99 which extends downwards into the slot 88 from the strip-advancing device 98 at this point is extended into a hole 108 in the first column 110 of the program strip 106. As the strip-advancing device 98 moves rearward, the program strip 106 is pulled rearward along with it. Upon reaching the rearmost point which the strip-advancing lever 102 can pivot , the spring 104 pulls the strip-advancing device 98 forward to its rest position. The tooth 99 is designed to ride up and out of the hole 108 which it was in, thus leaving the strip 106 in its new position. The tooth 99 then engages the next hole 108 in the line to repeat the process. The strip 106 is left in a position which aligns a new line of information with the holes 86*a–d* in strip reading device 78, and this information is then translated to the gates 62*a–c*. The above process continues until all cards have been sorted.

It is to be understood that the above description is not intended to limit in any way the scope of the present invention, and that the scope of the invention shall follow from the claims set forth below.

There has thus been described an invention which accomplishes at least all of the stated objectives.

I claim:

1. A card dealing and sorting apparatus comprising a frame including a pair of sidewalls defining a substantially vertical open well, a card holding device mounted on said frame;

card removal means operatively associated with said card holding device and mounted on said frame for removing one or more cards from said card holding device;

said open well being positioned for receiving a card from said card removal means whereby gravity can pull said cards down said well;

a plurality of gates adjacent said side wall of said open wells, each gate being movable between a card interception position within said well for directing a card into that gate, and a card bypass position removed from said well for free movement of a card past said gate, whereby said cards may be sorted as they fall down the well;

a plurality of card holding compartments whereby sorted cards may be held, an information-bearing program strip, means for reading said information from said strip, means for actuating said gates for movement between said card interception and bypass positions in response to the information read from said strip, whereby movement of said gates may be controlled by input of said information on said strips.

2. The card dealing and sorting apparatus of claim 1 wherein said frame further comprises a partial front plate extending between and connected to the upper portions of the front edges of said side plates.

3. The card dealing and sorting apparatus of claim 1 wherein said card holding device comprises a rectangular box with an open top, a base comprising a pair of support plates extending inwardly and connected to the lower edges of the shorter sides of said box and aligned such that the longitudinal axis of each of said support plates is substantially parallel to the horizontal transverse axis of said rectangular box, and a removable weight whereby said weight can be placed on top of said deck of cards when held within said card holding device, thereby facilitating removal of said cards by said removal means.

4. The card dealing and sorting apparatus of claim 1 wherein said card holding device is slidably mounted on top of said frame, whereby said card holding device may be slid in a plane extended across said frame.

5. The card dealing and sorting apparatus of claim 4 wherein said means for removing one or more cards from said card holding device further comprises a plate mounted substantially parallel to said sliding plane of said card holding device and having a card engaging shoulder on said plate, whereby a card may be removed from said card holding device.

6. The card dealing and sorting apparatus of claim 5 wherein said open well further comprises a substantially upright rear wall extending between and connected to said side plates of said frame and extending upwards from the bottom of said side plates to a point just beneath said slidably mounted card holding device.

7. The card dealing and sorting apparatus of claim 6 wherein each of gates further comprises a substantially rectangular plate, which is pivotally mounted such that the pivot axis of the gate is parallel to the longitudinal axis of said gate, adjacent the bottom of said gate, and extends between said side plates of said frame.

8. The card dealing and sorting apparatus of claim 7 wherein said gates are pivotally mounted such that when in card bypass positions, the gates comprise a substantially vertical wall surface spaced apart from and substantially parallel with said rear wall of said open well.

9. The card dealing and sorting apparatus of claim 8 wherein said gates are pivotally mounted such that when in a card intercept position, each of said gates extends between said rear wall of said open well and a chute leading to one of said card holding compartments, whereby said cards falling down said open well may be directed into the appropriate card holding compartment.

10. The card dealing and sorting apparatus of claim 1 wherein said information-bearing program strip further comprises a strip of flexible material through which a plurality of holes have been formed.

11. The card dealing and sorting apparatus of claim 10 wherein said means for reading said information from said strip further comprises a plurality of strip-reading members pivotally mounted on an axle and substantially parallel to each other and in space-apart relation for registration with respective holes in said strip.

12. The card dealing and sorting apparatus of claim 11 further comprising a strip guide mounted above said strip reading members, said strip guide comprising a pair of vertically spaced apart plates, closed on the longitudinal sides, and where said spacing between said plates is slightly greater than the thickness of said strip of flexible material, whereby said strip may be slid between said plates.

13. The card dealing and sorting apparatus of claim 12 wherein each of said strip-reading members has a first and second end.

14. The card dealing and sorting apparatus of claim 13 wherein said first ends further comprise a triangular-shaped tooth extending upwards.

15. The card dealing and sorting apparatus of claim 14 wherein said strip guide further comprises a plurality of spaced apart holes extending through both of said rectangular plates, whereby said teeth on said strip-reading members may extend upwards therethrough.

16. The card dealing and sorting apparatus of claim 15 wherein said card holding compartments further comprise generally L-shaped bent plates removably mounted on said side plates of said frame at positions such that the upper section of said L-shaped plate is below and in front of said gate so that upon movement of said gate to the card intercept position, said card may fall into said L-shaped plate and be held therein, said bent plates being removable from said card dealing and sorting apparatus with said sorted cards therein.

17. The card dealing and sorting apparatus of claim 15 wherein said teeth fit into said holes in said strip of flexible material whereby when said strip is slid through said strip guide, each of said strip-reading members can either be in engaged position, wherein said tooth of said strip-reading member is extended through a corresponding hole in said strip, thereby pivoting said strip-reading member about said axle, or said strip-reading member may be in disengaged position, wherein said tooth of said strip-reading member cannot extend through said strip, as no hole is in correct placement to allow extensions therethrough, thereby resulting in said strip-reading member not pivoting about said axle.

18. The card dealing and sorting apparatus of claim 17 wherein said second end of each of said strip-reading members is connected to said gates by a gate control member, whereby engagement of said strip-reading member results in involvement of the connected gate to the card intercept position, thereby allowing said cards to be directed to the desired card holding compartment.

19. The card dealing and sorting apparatus of claim 18 further comprising a strip advancing means operative to advance the information-bearing strip to the next position upon removal of a card from said deck, thereby allowing reading of the next line of gate control information.

20. A method for dealing and sorting a deck of cards comprising:

providing a frame, a card holding device movably mounted on said frame, removing means for cards, an open wall, a plurality of gates, a plurality of card holding compartments, and information-bearing program strip, means for reading said information bearing strip, and means for controlling said gates in accordance with said information on said strip, placing a deck of cards in said card holding device, sliding said information-bearing strip into said strip reading means, starting with said card holding device towards one end of said frame, sliding said card holding device toward said opposite end, then back, thereby releasing a card, directing the released card into the well in response to movement of said card holding device in one direction, whereby said card falls down into the open well, setting said gates in the appropriate card intercept or card bypass positions, as determined by the information on said strip as read by said strip reading means, and translated to said gates by said gate control means, thereby directing said card into the card holding compartment determined by said information on said strip, and repeating the above sequence until all cards in said deck are sorted.

* * * * *